US009688291B1

(12) United States Patent
Morhaus

(10) Patent No.: US 9,688,291 B1
(45) Date of Patent: Jun. 27, 2017

(54) SAFETY GATE FOR RAIL CAR

(71) Applicant: FPS Investments, LLC, Madison, IL (US)

(72) Inventor: Thomas Morhaus, Chesterfield, MO (US)

(73) Assignee: FPS Investments, LLC, Madison, IL (US)

( * ) Notice: Subject to any disclaimer, the term of this patent is extended or adjusted under 35 U.S.C. 154(b) by 0 days.

(21) Appl. No.: 15/087,191

(22) Filed: Mar. 31, 2016

Related U.S. Application Data

(60) Provisional application No. 62/143,529, filed on Apr. 6, 2015.

(51) Int. Cl.
*E06B 3/68* (2006.01)
*B61D 19/02* (2006.01)
*E06B 9/02* (2006.01)

(52) U.S. Cl.
CPC ..... *B61D 19/026* (2013.01); *E06B 9/02* (2013.01)

(58) Field of Classification Search
CPC ..... E61D 19/026; E06B 9/02
USPC ..... 49/50, 55, 57, 463
See application file for complete search history.

(56) References Cited

U.S. PATENT DOCUMENTS 1,451,172 A * 4/1923 Mayer ..... E06B 9/01 49/55
RE19,617 E * 6/1935 Dresser ..... E06B 9/01 160/225
4,394,805 A * 7/1983 Napper ..... E06B 9/01 49/141
4,437,265 A * 3/1984 Turro ..... E06B 9/02 292/305
4,680,890 A * 7/1987 Jokel ..... E06B 9/02 49/55
4,899,490 A * 2/1990 Jokel ..... E06B 9/02 49/55
5,018,302 A * 5/1991 Kluge ..... E05B 65/1033 292/304
5,070,647 A * 12/1991 Spialter ..... E06B 9/02 49/141
5,339,567 A * 8/1994 Pierpont ..... E06B 9/01 49/55
6,141,912 A * 11/2000 Graham ..... E06B 9/02 49/465
8,443,550 B1 * 5/2013 Burns ..... E06B 9/04 49/141
2013/0086842 A1 * 4/2013 Morrone, III ..... E06B 9/063 49/55

* cited by examiner

*Primary Examiner* — Jerry Redman

(74) *Attorney, Agent, or Firm* — Polster, Lieder, Woodruff & Lucchesi, LC

(57) ABSTRACT

An expandable safety gate for a vehicle door opening comprising a first substantially rectangular frame and a second substantially rectangular frame slidingly engaged in the first frame such that the two frames are positioned in the same vertical plane, the second frame being extendable from the first frame to fit within the door opening; and locking mechanisms to secure the second frame in its extended position within the vehicle door opening, wherein safety gate is comprised of non-conductive material.

8 Claims, 2 Drawing Sheets

SAFETY GATE FOR RAIL CAR

CROSS-REFERENCE TO RELATED APPLICATIONS

This application claims priority to U.S. App. No. 62/143,529 filed Apr. 6, 2015, which is entitled "Safety Gate for Rail Car" and which is incorporated herein by reference.

STATEMENT REGARDING FEDERALLY SPONSORED RESEARCH OR DEVELOPMENT

Not Applicable.

BACKGROUND

Safety equipment and more particularly a safety gate for use with an open door in a mass transit vehicle to prevent a maintenance worker from accidentally falling out the open door are disclosed herein.

Mass transit vehicle doors, for example rail car doors, and particularly doors employed in electrified cars such as subway cars or other mass transit rail cars, are automatically actuated to open and close, as is known in the art. As with any automated or mechanical apparatus the doors require regular maintenance or repair. During maintenance and repair of the doors the vehicle is taken out of service. Often the vehicle is transported to a yard for service. In many cases a vehicle door is opened and maintenance or repair personnel are positioned in the open doorway when working on the door, which exposes the worker to the possibility of falling out the open door, resulting in injury. It would be advantageous, therefore, to have a safety gate that can be installed in the door opening to prevent such falls. It also would be advantageous if the gate were light weight, transportable, easy to install and to remove and if it were easily adaptable to different size openings.

Moreover, the vehicle being serviced or repaired may be parked on rails having an electrified third rail, either on the track or in the yard. It would be advantageous if the safety gate is not electrically conductive, comprised of dielectric material so that inadvertent contact with an electrified rail does not pose a risk of electrocution or system shutdown.

BRIEF SUMMARY

An expandable safety gate for a vehicle door opening comprising a first substantially rectangular frame and a second substantially rectangular frame slidingly engaged in the first frame such that the two frames are positioned in the same vertical plane, the second frame being extendable from the first frame to be fitted to different sized rail car door openings. There are locking mechanisms to secure the second frame relative to the first frame in its useful extended position within the opening.

The safety gate is comprised of dielectric material, such as fiberglass or other non-conductive material, is lightweight, portable and easily installed and removed.

BRIEF DESCRIPTION OF THE SEVERAL VIEWS OF THE DRAWINGS

Corresponding reference numerals will be used throughout the several figures of the drawings.

DETAILED DESCRIPTION

Figure 1:
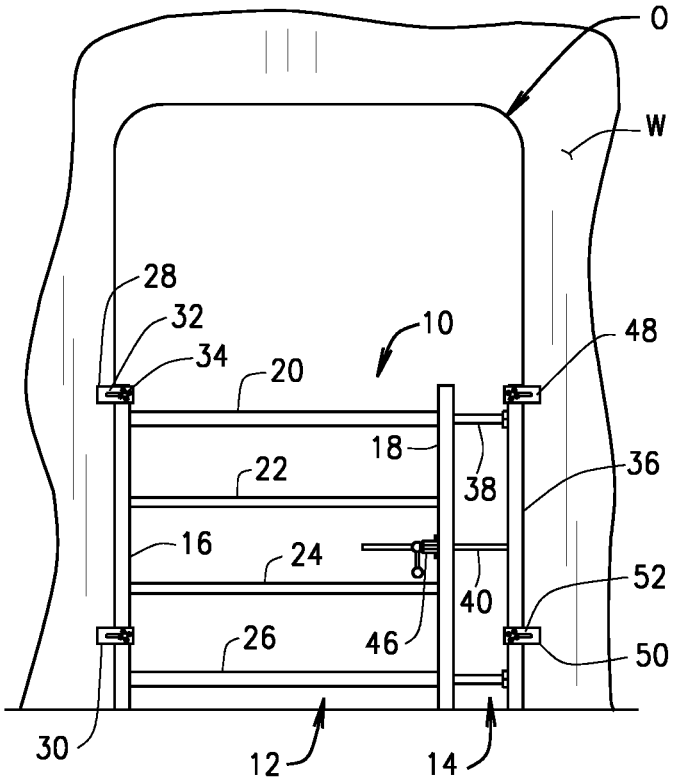
FIG. 1 is a front plan view of an aspect of the safety gate mounted in an open doorway.
Figure 2:
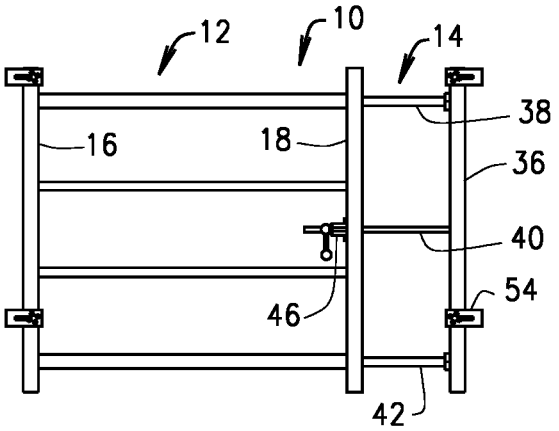
FIG. 2 is another front plan view of the gate.
Figure 3:
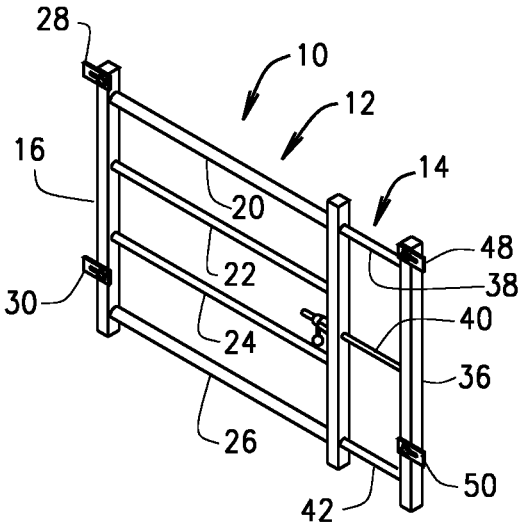
FIG. 3 is a front perspective view thereof.
Figure 4:
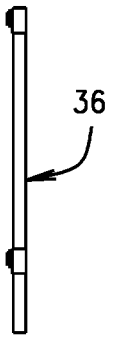
FIG. 4 is an end plan view.
Figure 5:
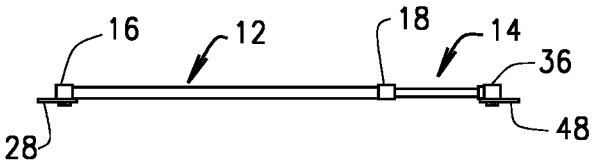
FIG. 5 is a top plan view thereof.

The following detailed description illustrates the safety gate by way of example and not by way of limitation. This description will clearly enable one skilled in the art to make and use the claimed invention, and describes several embodiments, adaptations, variations, alternatives and uses of the claimed invention, including what I presently believe is the best mode of carrying out the claimed invention. Additionally, it is to be understood that the safety gate is not limited in its application to the details of construction and the arrangements of components or the dimensions set forth in the following description or illustrated in the drawings. The safety gate is capable of other embodiments and of being practiced or being carried out in various ways. Also, it is to be understood that the phraseology and terminology used herein is for the purpose of description and should not be regarded as limiting.

Referring to the drawings, and particularly FIG. 1, one aspect of a safety gate is referred to generally by number 10. As shown, the gate 10 is installed in the opening O of a vehicle door. The vehicle can be any vehicle, such as a mass transit vehicle or rail car, for example, a rail car in a rapid transit or subway line. It will be understood, however, that gate 10 may be used in any environment to block an opening and prevent accidental or unintended egress through the opening, such as a fall out of the opening.

The gate 10 includes a first substantially rectangular frame 12 and a second substantially rectangular frame 14 at one end of the first frame. The first frame 12 includes a first vertical end post 16 and an opposed second vertical end post 18. In the illustrated aspect, there are four horizontal frame members, 20, 22, 24 and 26 extending between the end posts 16, 18. At least the upper and lower most horizontal frame members 20 and 26 define inner channels and have a larger cross-sectional area than the middle frame members 22 and 24.

There is an upper mounting bracket 28 at the top of first end post 16 and a lower mounting bracket 30 at the bottom of end post 16. Each mounting bracket includes a transverse slot 32 and can be attached to the vehicle wall W adjacent the opening O. A fastener 34 extends through the slot 32 and engages the post 16 to secure the post to the brackets. In one aspect, the fastener 34 can be a knob having a threaded extension that engages a threaded hole in the post. However, any fastener that conveniently and easily attached the post to the brackets may be employed.

The second rectangular frame 14 includes a vertical end post 36, an upper horizontal frame member 38, a center horizontal frame member 40 and a lower horizontal frame member 42. As shown, the upper frame member 38 and the lower frame member 42 are aligned with and dimensioned to slidingly engage inside the horizontal frame members 20 and 26, respectively, of the first rectangular frame. In one aspect, the center frame member 40 can define an externally threaded rod which extends through an opening (not seen) in the second end post 18 and through a locking device 46 located on the second end post 18. In the illustrated aspect, the locking mechanism 46 can be a handle with a threaded bore that engages the external threads on member 40. For example, the locking device 46 can be rotatably mounted to the second end post, such that as the locking device is rotated, the engagement of the threaded rod with the threads of the locking device cause the second frame to move axially relative to the first frame. Alternatively, locking mechanism 46 can employ a swaged arrangement that does not require threads on center frame member 40. Any locking mechanism will suffice.

There is an upper mounting bracket 48 at the top of first end post 36 and a lower mounting bracket 50 at the bottom of end posts 36. Each mounting bracket includes a transverse slot 52 and can be attached to the vehicle wall W adjacent opening O. A fastener 54 extends through slot 52 and engages post 36 to secure the post to the brackets.

In use, the width of the gate 10 can be adjusted to accommodate different widths of openings O. Brackets 28, 30, 48 and 50 can be removably secured to the wall W. Fasteners 34 and 54 are loosened and vertical end posts 16 and 36 are positioned adjacent the vertical walls of opening O. Because the upper frame member 38 and the lower frame member 42 of the second rectangular frame are slidingly engaged inside horizontal frame members 20 and 26, respectively, of the first rectangular frame 12, the second rectangular frame 14 can be extended or retracted laterally relative to the first rectangular frame to fit within the opening O. The gate 10 is optimally positioned in opening O, fasteners 34 and 54 are tightened and the locking mechanism 46 is secured around horizontal member 40 to secure the gate in place.

To remove the gate, brackets 28, 30, 48 and 50 can be removed from wall W. Alternatively, the fasteners 34 and 54 can be removed from the gate to release gate 10 from the vehicle, leaving the brackets 32 and 54 in place for future use.

The general dimensions of the various elements are relative and they are configured and dimensioned to fit in any desired opening. In one aspect, the various elements comprise a non-conductive material such as fiberglass or other resin. If the gate is to be installed where there is no exposure to electric current, the various elements may comprise another lightweight and durable material such as light gauge steel, aluminum or alloys.

In view of the above, it will be seen that the several objects and advantages of the present invention have been achieved and other advantageous results have been obtained.

As various changes could be made in the above constructions without departing from the scope of the invention, it is intended that all matter contained in the above description or shown in the accompanying drawings shall be interpreted as illustrative and not in a limiting sense.

The invention claimed is:

1. An expandable safety gate for a vehicle door opening comprising:

a first substantially rectangular frame comprising first frame end posts and at least one horizontal frame member extending between the end posts; said first frame end posts consisting of two end posts which define a first end post and a second end post of said expandable safety gate; said at least one horizontal frame member being hollow; said second end post having an opening aligned with said hollow horizontal frame member;

a second substantially rectangular frame comprising a second frame end post and at least one horizontal slide member and a center frame member; said second frame end post consisting of one end post, said one end post being a third end post of said expandable safety gate; said at least one horizontal slide member extending from said third end post and being positioned on said third end post to be axially aligned with said opening in said second end post and with said at least one hollow horizontal frame member; said at least one horizontal slide member being sized to be telescopingly received in said at least one hollow horizontal frame member; whereby said second frame is moveable axially relative to said first frame, enabling the gate to be sized to fit within the door opening; and a locking mechanism engaging said center frame member to secure the second frame in a desired position relative to the first frame.

2. The expandable safety gate of claim 1;

wherein safety gate is comprised of non-conductive material.

3. The safety gate of claim 1 wherein said at least one horizontal hollow frame member of said first frame comprises two hollow frame members spaced apart from each other; and wherein said at least one horizontal slide member of said second frame comprises two slide members sized and positioned be slidably received in said hollow frame members of said first frame.

4. The safety gate of claim 3 wherein first and second hollow frame members of said first frame comprise upper and lower frame members, and wherein said first frame further includes at least one additional frame member extending between said first and second end posts between said upper and lower frame members.

5. The safety gate of claim 1 further including at least one mounting bracket for said first end post and at least one mounting bracket for said third end post, said mounting brackets being adapted to secure said gate to a surface on opposite sides of an opening and said mounting brackets being independent from the end posts, said brackets being adapted to be selectably engaged by said end posts.

6. The safety gate of claim 5 wherein said mounting brackets further include a fastener which extends through an opening in said brackets to secure said brackets to the first and third end posts.

7. The safety gate of claim 1 wherein the locking mechanism comprises a rod extending from said third end post through an opening in said second end post and a lock received on said rod on a side of said second end post opposite said third end post; whereby said lock engages said rod and said second end post to prevent movement of said second frame relative to said first frame in at least one direction.

8. The safety gate of claim 7 wherein said rod is externally threaded, and said lock includes an internally threaded member rotatably mounted to said second post, said lock being sized such that the threads of the lock engage the threads of the rod; whereby rotation of the lock relative to the rod causes the second frame to move axially relative to the first frame.

* * * * *